US006793381B2

(12) United States Patent
Marsh

(10) Patent No.: US 6,793,381 B2
(45) **Date of Patent: *Sep. 21, 2004**

(54) CCFL ILLUMINATED DEVICE AND METHOD OF USE

(75) Inventor: Brent Marsh, San Francisco, CA (US)

(73) Assignee: BJI Energy Solutions, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/414,714

(22) Filed: Apr. 15, 2003

(65) Prior Publication Data

US 2003/0179577 A1 Sep. 25, 2003

Related U.S. Application Data

(63) Continuation of application No. 09/598,009, filed on Jun. 20, 2000, now Pat. No. 6,616,310, which is a continuation-in-part of application No. 08/630,361, filed on Apr. 10, 1996, now Pat. No. 6,135,620.

(51) Int. Cl.[7] ..... F21V 15/00
(52) U.S. Cl. ..... 362/377; 362/223; 313/25
(58) Field of Search ..... 362/377, 222, 362/223, 225, 255, 367; 313/318.02, 17, 25, 518, 634; 40/570

(56) References Cited

U.S. PATENT DOCUMENTS

| | | | | |
|---|---|---|---|---|
| 3,358,167 A | * | 12/1967 | Shanks | 313/25 |
| 4,247,884 A | * | 1/1981 | McJunkin et al. | 362/164 |
| 4,924,368 A | * | 5/1990 | Northrop et al. | 362/376 |
| 4,963,785 A | * | 10/1990 | Takagi et al. | 313/318.08 |
| 5,291,379 A | * | 3/1994 | Lu | 362/255 |
| 5,510,965 A | * | 4/1996 | Teakell | 362/223 |

* cited by examiner

*Primary Examiner*—Thomas M. Sember
*Assistant Examiner*—Hargobind S. Sawhney
(74) *Attorney, Agent, or Firm*—Marvin H. Kleinberg; Marshall A. Lerner; Kleinberg & Lerner, LLP

(57) ABSTRACT

Cold cathode fluorescent lamps (CCFLs), associated devices and methods of use, and more specifically, exit signs, traffic signals, informational and other signage and lighting devices utilizing CCFL-type devices are provided with novel connectors, mounting brackets, housings, associated electronics and other accessories to provide new and unique lighting devices and methods of using them, all of which offer significant savings in cost, operating expense, power consumption and retrofit convenience.

17 Claims, 9 Drawing Sheets

CCFL ILLUMINATED DEVICE AND METHOD OF USE

This is a continuation of U.S. patent application Ser. No. 091598,009, filed Jun. 20, 2000, now U.S. Pat. No. 6,616, 310 which is a continuation-in-part of U.S. patent application Ser. No. 08/630,161 filed Apr. 10, 1996, now U.S. Pat. No. 6,135,620, issued Oct. 24, 2000.

FIELD OF INVENTION

This invention relates generally to miniature cold cathode fluorescent lamps (CCFLs) and other miniature fluorescent lamps, associated devices and methods of use, and more specifically, to exit signs, informational and other signage and lighting devices utilizing CCFL-type devices in conjunction with novel connectors, mounting brackets, housings and other accessories to provide new and unique lighting devices and methods of using them, all of which offer significant savings in cost, operating expense, power consumption and retrofit convenience.

BACKGROUND OF THE INVENTION

Electrically powered exit signs, traffic signals, task lights and other devices are widely used. Fluorescent lamps are used to provide illumination in typical electrical devices for general lighting purposes because they are more efficient than incandescent bulbs in producing light. A fluorescent lamp is a low pressure gas discharge source, in which light is produced predominantly by fluorescent powders activated by ultraviolet energy generated by a mercury plasma forming an arc. The lamp, usually in the form of a tubular bulb with an electrode sealed into each end, contains mercury vapor at low pressure with a small amount of inert gas for starting. The inner walls of the bulb are coated with fluorescent powders commonly called phosphors. When the proper voltage is applied, the plasma forming an arc is produced by current flowing between the electrodes through the mercury vapor. This discharge generates some visible radiation. The ultraviolet in turn excites the phosphors to emit light.

Two electrodes are hermetically sealed into the bulb, one at each end. These electrodes are designed for operating as either "cold" or "hot" cathodes or electrodes, more correctly called glow or arc modes of discharge operation. Electrodes for glow or cold cathode operation may consist of closed-end metal cylinders, generally coated on the inside with an emissive material. Conventional cold cathode lamps operate at a current on the order of a few hundred milliamperes, with a high cathode fall or voltage drop, something in excess of 50 volts. CCFLs are not appreciably affected by starting frequency because of the type of electrode used CCFLs emit light in the same way as to standard hot electrode lamps. The latter type operate as normal glow discharges and their electrodes are uncoated hollow cylinders of nickel or iron. The cathode fall is high and to obtain high efficacy or power for general lighting purposes, conventional lamps are made fairly long, about 2–8 feet, with a diameter of about 25–40 millimeters. About 2000 volts is required for starting these conventional lamps and about 900 to 1000 volts for running.

The advantages of CCFLs compared with the hot electrode fluorescent lamps are that they have a very long life (usually) 15000 hours or more) in consequence of their rugged electrodes, lack of filament and low current consumption. They start immediately, even under cold ambient conditions. Their life is unaffected by the number of starts. Also, they may be dimmed to very low levels of light output.

U.S. Pat. No. 4,650,265 issued Mar. 17, 1987 to Holtzman teaches an illuminating lamp assembly for retrofitting an exit sign. This invention is directed towards a retrofit system with a rotatably threaded electrical connector for interfacing with an existing standard home-type incandescent light bulb electrical socket and a standard non-CCFL bulb and retaining arms configuration horizontally and rotatably mounted to the electrical connector.

U.S. Pat. No. 5,018,290 issued May 28, 1991 to Kozeketal. Teaches an exit sign with a plurality of low voltage incandescent lamp mounted on a printed circuit board to provide illumination from within a housing. Stenciled images are used on the external, semi-transparent housing surfaces.

U.S. Pat. No. 5,365,411 issued Nov. 15, 1994 to Rycroft et al. Teaches exit signs with illumination. Arrays of light emitting diodes are disposed in spaced relationship above a rear wall configured to reflect light emitted from the did/odes relatively uniformly across a diffuser which further contributes to relative uniform transmission of light therethrough. The system uses low direct voltage diodes.

U.S. Pat. No. 5,388,357 issued Feb. 14, 1995 to Malita teaches a kit using LED units for retrofitting illuminated signs. The kit retrofits a conventional exit sign, which normally uses internally mounted incandescent or fluorescent lamps, to operate using multiple LED sources in a group or assembly on a board. Indicia lighting is accomplished substantially indirectly through reflection of light from the LED sources which are powered through an adapter that fits into the socket of the original incandescent lamp or fluorescent lamp which is removed in the retrofit process.

U.S. Pat. No. 5,410,453 issued Apr. 25, 1995 to Ruskouski teaches a lighting device used in an exit sign. A light emitting diode lighting device is provided for mating engagingly with an electrical socket of the lighting fixture. The light emitting diode device has a plurality of LEDs recessed in frustoconical apertures for directing light into a desired illumination pattern.

U.S. Patent No. 5,4 16,679 issued may 16, 1995 to Ruskouski et al. Teaches a mounting base assembly for a lighting device used in an exit sign. In the lighting fixture such as an exit sign, a mounting base assembly is provided on a light emitting diode lighting device for mating engagement with an electrical socket Once full mating engagement is achieved between the electrical socket and a base member of the mounting base assembly, the position of the housing carrying the light emitting diodes of the lighting device can be adjusted for alignment purposes without disturbing the full mating engagement of the electrical socket and the base member.

U.S. Patent No. 5,428,515 issued Jun. 27, 1995 to Jung teaches an electric lighting assembly. The assembly included a protective holder formed on the top with two holes and at two opposite sides with depending lugs, said lugs having a hook portion at the lower end, a ring contact secured on the top of said protective holder. A contact is provided on the top with a tip contact and the outer peripheral wall with spiral threads, said tip contact and said spiral threads being electrically connected with the two holes of said protective holder, a conical member connected with the two holds of said p protective holder and supported by the hook of said lugs, and a neon light bulb connected with said conical member, whereby the neon light can be used indoors.

LED 8 ½"Red Signal & Retrofit Kit, Econolite Control Products; Inc., Anaheim, Calif. (undated, 2 pages). This signal head section uses a circuit board with 420 to 675 individual ultra-bright red 2000 mcd LEDs to replace the conventional lamp, socket and reflector assembly of a conventional 8 ½" incandescent red signal head. It is powered directly by 120 volts alternating current. Because the LEDs are packed more densely in the center, it is nearly indistinguishable from its incandescent counterpart in brightness, color and viewing angle. Visibility is excellent, even in bright sunlight. A wide viewing angle is achieved with the use of a faceted red lens.

U.S. Patent No. 5,440,467 issued Aug. 8, 1995 to Lautzenheiser teaches a task light. The light assembly is provided for illuminating a work surface below and in front of the light assembly, and includes a housing configured for mounting over the work surface with an elongated linear light source supported in its housing. A tubular lens is built into and part of the housing, and includes prism-shaped triangular rings on its inside surface for controlling the light from the light source onto the work surface therebelow.

Exit signs are currently illuminated with a variety of light sources in a variety of methods. The electric light sources currently include incandescent, compact and tubular fluorescent lamps, electro-luminescent (EL lamps and light emitting diodes (LEDs). LED technology offers low power consumption, long lamp lives, and low maintenance requirements. With LED illuminated signs, annual energy and maintenance costs can be reduced by more than 90% compared to a typical sign using incandescent lamps. LED technology represents the greatest improvement over incandescent and compact fluorescent lamps. However, there are many limitations to performance inherent with LEDs. Performance of LEDs in illuminated signage and traffic signals is limited because LEDs emit light directionally and only in discrete colors, such as red, green and yellow. Red has the highest lumen/watt output, while green and the other colors emitted by LED drop off to about 30% of the red lumen level. Due to the directionality of the light output of LED and the color limitations, applications are restricted. Due to the variable brightness, green and other colors are not readily adaptable in may applications. More LEDs are needed to equal the luminosity of the red LED. Space restraints come into play and wattage consumption goes up accordingly.

CCFLs emit white light omnidirectionally, while combining low power consumption, long lamp lives, and low maintenance requirements similar to LEDs. Light outputs remain constant for all colors, not like LEDs whose light output varies with each color. The omnidirectional white light output is a key factor in the present invention.

SUMMARY OF THE INVENTION

The present invention is a cold cathode fluorescent lamp (CCFL) illuminated sign, the sign operating off a main source of electrical power. The sign comprises a CCFL, the CCFL being elongated and having a predetermined length, the CCFL having a first end and a second, the CCFL having a fast electrode at the fast end and a second electrode at the second end. The sign also comprises an outer tubular housing, the housing essentially transparent, the housing having a first end and a second end, the tubular housing having a predetermined length essentially the same as that of the CCFL, the tubular housing having a central hollow opening, the CCFL disposed within the tubular housing. The sign also has two end fittings, the end fittings each having a small central opening axially the rethrough, the end fittings each comprising a lamp side and a contact side, the lamp side designed to receive a first end or a second end of the CCFL within the small central opening, the end fittings each having a radially spaced lip around the small central opening, the lip shaped to receive the first end or the second end of the outer tubular housing and hold the end radially spaced from the CCFL, the end fittings each having an attachment means for mounting the end fitting onto the CCFL and tubular housing. The sign also has CCFL mounting means, the CCFL mounting means comprising a pair of resilient prong members which grasp the end fittings securely and releasably. The sign also has a ballast means, the ballast means comprising an electrical circuit and associated electronics including control means, the ballast means having an input and an output, the input being connected to the main source of electrical power, the output connected to the CCFL electrodes, the ballast receiving a predetermined electrical input and producing an electrical output sufficient to stimulate the CCFL to produce illumination. The sign also has a housing, the housing comprising the following: a top portion; a base portion; a plurality of side members, the CCFL mounting means attached to either the top portion, the base portion or one of the plurality of side members; a plurality of viewing panels, the viewing panels bearing illuminated graphic indicia; and a housing mounting means, the housing mounting means providing a sturdy, convenient mounting for the illuminated sign.

In a preferred embodiment the end fittings are made of rubber. In a preferred embodiment the pair of resilient prong members has a contoured end fitting retaining means, the contoured end fitting retaining means opposingly spaced on each of the pair of resilient prong members so as to grasp the end fittings securely and releasably. In a preferred embodiment each of the pair of resilient prong members has a plurality of contoured and fitting retaining means, the plurality of contoured end fitting retaining means opposingly spaced on each of the pair of resilient prong members so as to grasp the end fittings securely and releasably in a plurality of positions. In a preferred embodiment there is a plurality of CCFLs. In a preferred embodiment there is a plurality of CCFL mounting means. In a preferred embodiment the indicia of the illuminated sign is for an exit sign. In a preferred embodiment the indicia of the viewing panels is made of a transparent or semi-transparent material to allow illumination through the indicia graphics.

The present invention further includes a cold cathode fluorescent lamp (CCFL) illuminated exit sign retrofit kit, the retrofit kit comprising a light assembly, the light assembly comprising: a CCFL, the CCFL being elongated and having a predetermined length, the CCFL having a first end and a second, the CCFL having a first electrode at the first end and a second electrode at the second end; an outer tubular housing, the housing essentially transparent, the housing having a first end and a second end, the tubular housing having a predetermined length essentially the same as that of the CCFL, the tubular housing having a central hollow opening, the CCFL disposed within the tubular housing; and two end fittings, the end fittings each having a small central opening axially therethrough, the end fittings each comprising a lamp side and a contact side, the lamp side designed to receive a first end or a second end of the CCFL within the small central opening, the end fittings each having a radially spaced lip around the small central opening, the lip shaped to receive the first end or the second end of the outer tubular housing and hold the end radially spaced from the CCFL, the end fittings each having an attachment means for mounting the end fitting onto the CCFL and tubular housing. The retrofit kit has a light assembly mounting means, the light assembly mounting means comprising a pair of resilient prong members which grasp the end fittings securely and releasably. There is a ballast means, the ballast means comprising an electrical circuit and associated electronics including control means, the ballast means having an input and an output, the input being connected to the main source of electrical power, the output connected to the CCFL electrodes, the ballast receiving a predetermined electrical input and producing an electrical output sufficient to stimulate the CCFL to produce illumination. There is a housing, the housing comprising the following: a top portion; a base portion; a plurality of side members, the light assembly mounting means attached to either the top portion, the base portion or one of the plurality of side members; a plurality of viewing panels, the viewing panels bearing illuminated graphic indicia; and a housing mounting means, the housing mounting means providing a sturdy, convenient mounting for the illuminated sign. There is also a socket connector, the socket connector comprising: a socket member, the socket member having a threaded lower portion, the threads designed to fit into the female socket portion for typical incandescent-type light bulbs found within existing exit signs, the socket member having an upper portion with electrical contact receiving slots; a plug portion, the plug portion having two prongs extending from the plug portion so as to fit securely within receiving slots in the upper portion of the socket member; and a lead wire extending from the plug portion, wherein an electrical circuit is formed with the main power source, the ballast means and the CCFL when the prongs of the plug portion are inserted into receiving slots in the socket member.

The invention further includes a cold cathode fluorescent lamp (CCFL) illuminated traffic signal, the signal operating off a main source of electrical power, the signal comprising a plurality of CCFLs, the CCFLs each being elongated and having predetermined lengths, the CCFLs each having a first end and each having a second end, the CCFLs each having a first electrode at the first end and a second electrode at the second end. There is a plurality of outer tubular housings, the housings each essentially transparent, each housing having a first end and a second end, the tubular housings each having predetermined lengths essentially the same as those of the CCFLs, the tubular housings each having central hollow openings, the CCFLs each singularly disposed within the tubular housings. There is a plurality of end fittings, the end fittings each having a small central opening axially therethrough, the end fittings each comprising a lamp side and a contact side, the lamp side designed to receive a first end or a second end of the CCFL within the small central opening, the end fittings each having a radially spaced lip around the small central opening, the lip shaped to receive the first end or the second end of the outer tubular housing and hold the end radially spaced from the CCFL, the end fittings each having an attachment means for mounting the end fittings onto a CCFL and a tubular housing. There is a plurality of CCFL mounting means, the CCFL mounting means each of which grasp the end fittings securely and releasably. There is a ballast means, the ballast means comprising an electrical circuit and associated electronics including control means, the ballast Means having an input and a plurality of outputs, the input being connected to the main source of electrical power, the outputs each connected to the CCFL electrodes, the ballast receiving a predetermined electrical input and producing electrical outputs sufficient to stimulate the CCFL to produce illumination. There is a housing, the housing comprising the following: a back chamber, the back chamber containing the ballast; an illumination chamber, the plurality of CCFL mounting means mounted within the illumination chamber to support the plurality of CCFLs; and a viewing lens, the viewing lens removably mounted in front of the illumination chamber.

The invention further includes a cold cathode fluorescent lamp (CCFL) light assembly, the light assembly comprising a miniature elongated CCFL, the CCFL having a first end and a second end and a central axis, the CCFL having a first electrode at the first end and a second electrode at the second end. There are two end walls, the end walls essentially parallel to each other and essentially perpendicular to the central axis of the CCFL, the end walls each having an inside surface and an outside surface, the CCFL attached to the sidewalls at the fast end and the second end. There arc two electrical contacts, the electrical contacts disposed on the outside surfaces of the end walls. There is a plurality of essentially transparent protective panels, the protective panels extending between the end walls, the protective panels having end sections attached to the end walls, the protective panels oriented so a to form a sealed interior chamber containing the CCFL. There is a releasable mounting means, the mounting means positioning the light assembly in a suitable housing for producing the desired illumination. In a preferred embodiment the end walls are essentially rectangular and the protective panels are essentially rectangular. In a preferred embodiment the end walls are essentially circular and there is a single essentially tubular protective panel.

The invention further includes a cold cathode fluorescent lamp (CCFL) illuminated task light, the task light utilizing a main power source, the task light comprising a plurality of CCFLs, the CCFLs each being elongated and having predetermined lengths, the CCFLs each having a fast end and each having a second end, the CCFLs each having a first electrode at the first end and a second electrode at the second end. There is a plurality of outer tubular housings, the housings each essentially transparent, each housing having a first end and a second end, the tubular housings each having predetermined lengths essentially the same as those of the CCFLs, the tubular housings each having central hollow openings, the CCFLs each singularly disposed within the tubular housings. There is a plurality of end fittings, the end fittings each having a small central opening axially therethrough, the end fittings each comprising a lamp side and a contact side, the lamp side designed to receive a first end or a second end of the CCFL within the small central opening, the end fittings each having a radially spaced lip around the small central opening, the lip shaped to receive the first end or the second end of the outer tubular housing and hold the end radially spaced from the CCFL, the end fittings each having an attachment means for mounting the end fittings onto a CCFL and a tubular housing. There is a plurality of CCFL mounting means, the CCFL mounting means each of which grasp the end fittings securely and releasably. There is a ballast means, the ballast means comprising an electrical circuit and associated electronics including control means, the ballast means having an input and a plurality of outputs, the input being connected to the main source of electrical power, the outputs each connected to the CCFL electrodes, the ballast receiving a predetermined electrical input and producing electrical outputs sufficient to stimulate the CCFL to produce illumination. There is a housing, the housing comprising an elongated covering, the covering shaped to contain the CCFL and tubular housing assembly.

The invention further includes a cold cathode fluorescent lamp (CCFL) illuminated A-lamp shaped light bulb, bulb utilizing a main power source, the bulb comprising a CCFL, the CCFL being elongated and having a predetermined length and geometric configuration, the CCFL having a fast end and having a second end, the CCFLs each having a first electrode at the fast end and a second electrode at the second end. There is an A-lamp shaped body portion, the A-lamp shaped body portion made of a suitable transparent material. There is a CCFL mounting means, the CCFL mounting means grasping the CCFL securely for mounting within the A-lamp shaped body portion. There is a ballast means, the ballast means comprising an electrical circuit and associated electronics including control means, the ballast means having an input and an output, the input being connected to the main source of electrical power, the output connected to the CCFL electrodes, the ballast receiving a predetermined electrical input and producing electrical outputs sufficient to stimulate the CCFL to produce illumination. There is a bulb mounting socket base portion, the socket base portion having a predetermined geometric configuration, the bulb mounting socket base portion further comprising a plurality of electrical contacts, the contacts connected to the input to the ballast, the contacts configured as in the contacts on the base of a conventional incandescent A-lamp light bulb. Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE INVENTION

Figure 1:
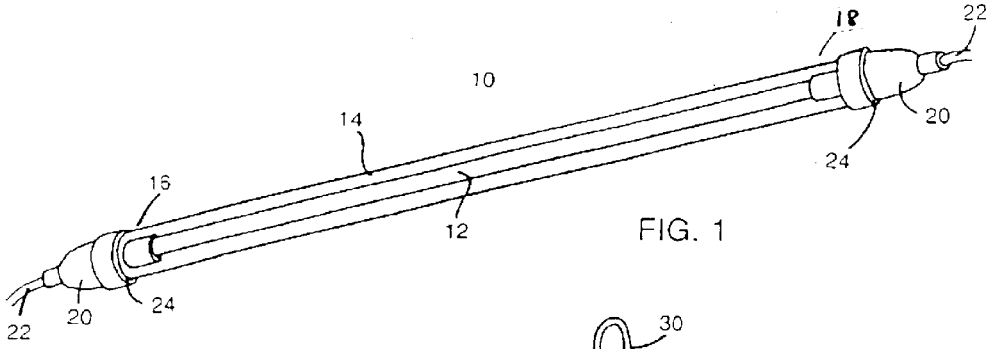
FIG. 1 is a perspective view of a preferred embodiment of the CCFL lamp assembly of the present 5 invention.

FIG. 1 is a perspective view of a preferred embodiment of the CCFL lamp assembly 10 of the present invention. The assembly consists of a CCFL lamp 12, held inside an outer tubular housing 14 at a first end 16 15 and a second end 18. The CCFL lamp is supported and held in place inside the end fittings 20. These end fittings can be any type of fitting which will hold a lamp in place, preferably with some degree of support to protect against vibration, etc, In a preferred embodiment, they consist of small rubber or plastic grommets or bushings which fit inside either end of the outer tubular housing 14. The CCFL lamp 12 is supported inside the grommet and contact lead wires 22 can be installed in electrical contact with the electrodes of the lamp. An outer groove 24 on the outside of the grommet element is designed for use in lamp holders or other systems in which a thin wire or loop of other material might grip the lamp assembly at that point The following table is a list of CCFL lamp specifications for a lamp used in a preferred embodiment of the present invention.

Typical CCFL Lamp Specifications

| | | | |
|---|---|---|---|
| 1 | Lamp Current | 5.0 | mA |
| 2 | Lamp Voltage | 400–1200 | Vac |
| 3 | Lamp Wattage | 2.5 | W |
| 4 | Color Temperature | 4800° K. | |
| 5 | Lumen Output @ 100% output | 25,000 | cd/m$^2$ |
| 6 | System Watts @ 100% output | 5 | W |
| 7 | Lamp Lengths | 160 | mm |
| 8 | Lamp Diameter | 3 | mm |
| 9 | On/Off cycles during life | At least 100,000 | cycles |
| 10 | Lamp Life @ 120% output | 20,000 | hours |

Figure 2:
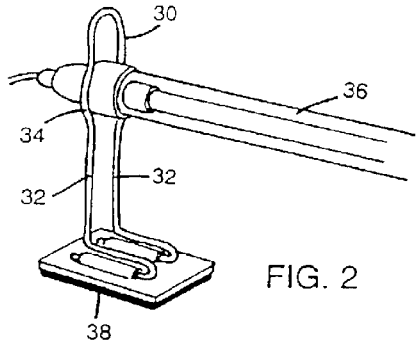
FIG. 2 is a perspective view of a preferred embodiment of a mounting clip of the present invention.

FIG. 2 is a perspective view of a preferred embodiment of a mounting clip 30 of the present invention. As discussed above, the resilient prong portions 32 have a set of opposing hemispherical indentations 34 inside of which a lamp assembly 36 could be mounted. Any lamp assembly gripping or securing means, including clips, nuts, adhesives, etc. could be suitable. It will be understood that the base 38 of the mounting clip would be attached to the inside of a protective, essentially transparent lamp assembly housing.

Figure 3:
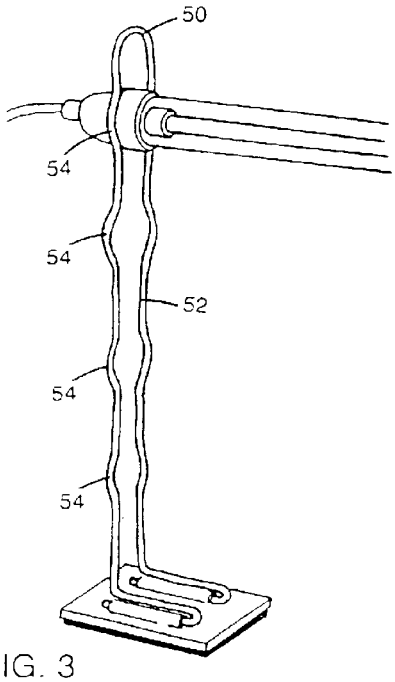
FIG. 3 is a perspective view of a preferred embodiment of a multi-lamp assembly mounting clip of the present invention.
Figure 4:
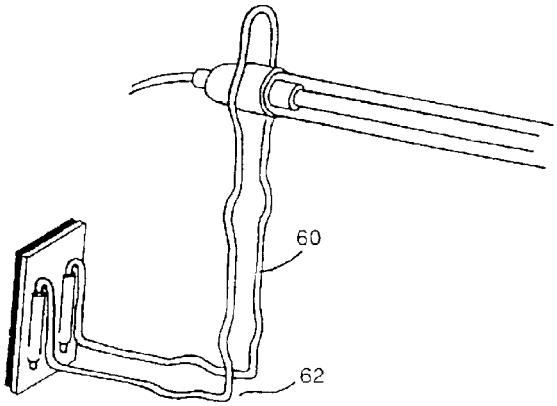
FIG. 4 is a perspective view of a preferred embodiment of an angled multi-lamp assembly mounting clip of the present invention.

FIG. 3 is a perspective view of a preferred embodiment of a multi-lamp assembly mounting clip of the present invention. In a preferred embodiment of the present invention, the mounting clip 50 has elongated resilient prong portions 52. Furthermore, a plurality of sets of opposing hemispherical indentations 54 provide a convenient way to install more than one lamp assembly at one time. In this configuration, the mounting clamps can be used to support replacement as well as multiple lamp assemblies powered simultaneously or in sequence. By using colored transparent tubular housings in the lamp assemblies, these plurality of lamp assemblies can provide colored illumination in a variety of signage and other application configurations. Embodiments of the CCFL illuminated devices of the present invention will have one or more lamp assemblies, the plurality of lamp assemblies provided for increased illumination, illumination in a sequence of different colored or other distinguishing type lamps or lamp assemblies, back-up or fail safe systems, etc. FIG. 4 is a perspective view of a preferred embodiment of an angled multi-lamp assembly mounting clip of the present invention. The resilient prong portions 60 are bent in a right angle, or other, near bend point 62. The precise angles, lengths, mounting configurations, positions and attachment means for the, mounting clip will be variable and adjustable, as necessary or desired.

Figure 5:
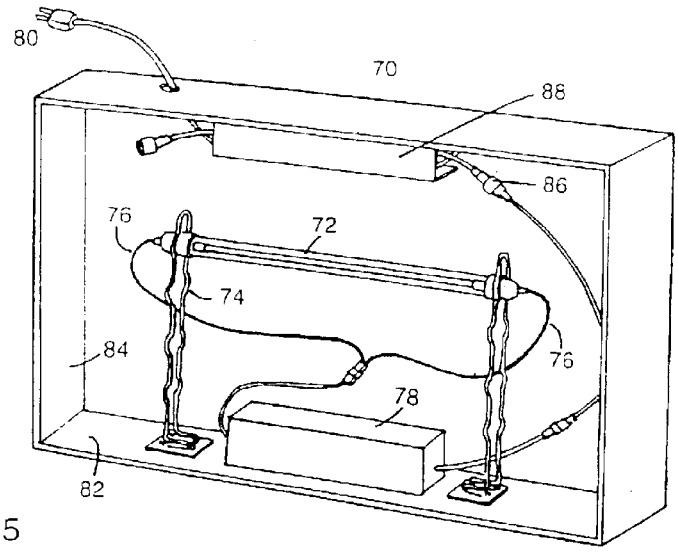
FIG. 5 is an internal view of a preferred embodiment of an exit sign unit of the present invention.

FIG. 5 is an internal view of a preferred embodiment of an exit sign unit of the present invention. The unit 70 consists of the lamp assembly 72 and mounting means 74. The lead wires 76 attached to either end of the lamp assembly lead to a ballast 78. This ballast or other power regulating means is essentially an AC/AC device, although it will be apparent to those skilled in the art that the precise operating parameters of the regulating means may vary depending upon the application and options necessary or desired. For example, the ballast could be adapted to provide the system with the necessary activation and operating power from either an ACline voltage, AC modified voltage, DC battery (for example with units providing a back-up or emergency-type illumination) or other power source. Ballasts are well known in the art widely available and the precise operating parameters can be specified depending upon the exact type of bulb and application being used. The main power connection 80 can be any suitable connector fitting or other means for supplying a connection to the power source. In a preferred embodiment of the present invention, the ballast and mounting means can be secured to an inside surface 82 of a housing 84. Connectors or splicing devices 86 are well known and will be utilized in the preferred embodiment of the present invention. A connection box 88 serves to house the connectors and other mounting means for the wiring harness.

The following table is a list of typical ballast means operating specifications of a preferred embodiment of the present invention.

| | Typical Average Ballast Means Specifications | |
|---|---|---|
| 1 | Input Voltage | 120 VAC |
| 2 | Input Current | 57 mA |
| 3 | Output Current | 5 mA |
| 4 | Output Voltage | 1100 VAC |

It will be noted that in addition to ballasts for converting from 120 VAC, numerous other types and designs are available and will be known to those skilled in the art. Other input voltages include 277 VAC and 5, 6 and 12 VDC and others.

Figure 6:
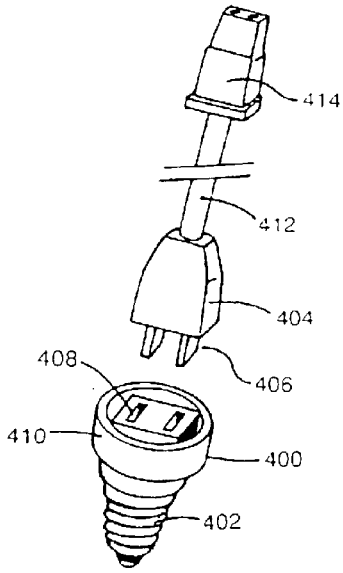
FIG. 6 is an internal view of a socket connector of a preferred embodiment of an exit sign retrofit unit of the present invention.

FIG. 6 is an internal view of a socket connector of a preferred embodiment of an exit sign retrofit unit of the present invention. In this embodiment, a socket member 400 has a threaded lower portion 402. These threads are designed to fit into the female socket portion found within existing exit signs. Typically, a conventional incandescent-type light bulb will thread inside the female socket portion. A plug portion 404 has two prongs 406 extending so as to fit securely within receiving slots 408 in the upper portion 410 of the socket member 400. A lead wire 412 will extend from plug portion 404 and connect, via connector or other splicing device 414 to the ballast to provide electrical energy from the existing lamp socket to a newly installed CCFL lamp assembly. Once the socket member 400 is inserted into an existing female socket portion 404 in an exit sign and the CCFL lamp assembly with ballast is installed in the housing of an existing or new exit sign, the plug portion can be plugged into the socket member 400. In this configuration, a safe and efficient retrofit system is provided, obviating the hazards associated with electrical installations, upgrades and renovations.

Figure 7:
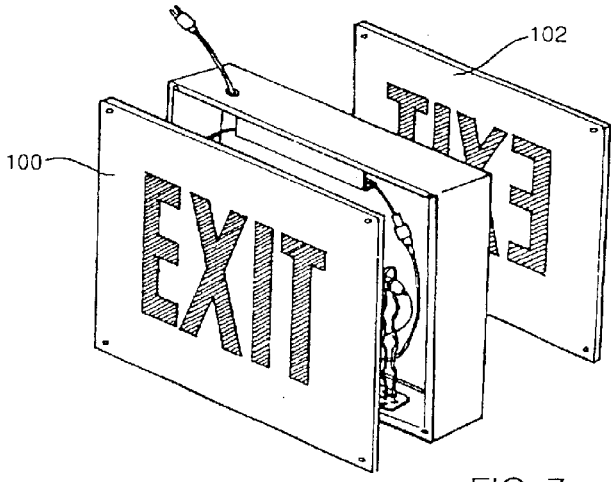
FIG. 7 is an internal view of a preferred embodiment of an exit sign unit of the present invention having two viewing sides.

FIG. 7 is an expanded perspective view of a preferred embodiment of an exit sign unit of the present invention having two viewing sides. It will be understood that there will be at least one and customarily one or two viewing sides. A first viewing side 100 and a second viewing side 102 can be detachable. It will be apparent to those skilled in the art that the present invention offers an exit sign unit which can be viewed from one or more sides using the same illumination source inside the housing. As opposed to LEDs or other similarly mounted bulbs, the present invention utilizes components which can be mounted inside the housing providing illumination in all directions. The viewing sides consist of opaque or other non-transparent material. The lettering 104 is essentially transparent, optionally red or green or other colored, and can be configured as a stencil-type visual.

Figure 8:
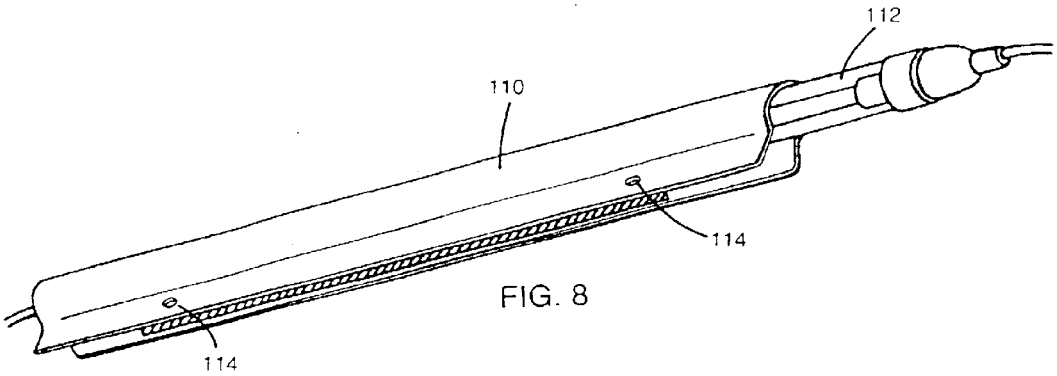
FIG. 8 is a perspective view of a preferred embodiment of a lamp assembly with reflector of the present invention.

FIG. 8 is a perspective view of a preferred embodiment of a lamp assembly with reflector of the present invention. The elongated reflector element 110 has a tubular shape with an internal diameter closely matching the outside diameter of the lamp assembly tubular housing 112. Mounting holes 114 may be indicated in those embodiments utilizing cross screws or other fastening means extending through a pair of bilateral, radially extending axial fins. The fins extend radially outward from the center of the radius about which the reflector element is curved. It will be understood by those skilled in the art that reflector elements may take various forms, including films, foils, etc. In a preferred embodiment, the reflector is an adhesive-coated or other reflective layer which is applied to the surface of the outer tubular housing of the lamp assembly.

Figure 9:
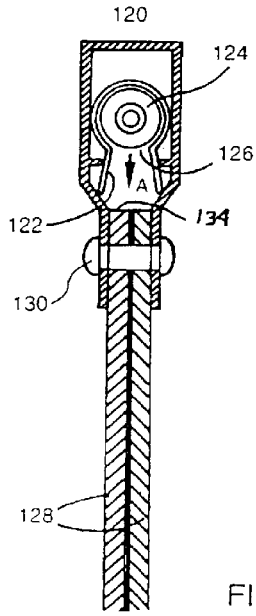
FIG. 9 is an end cross section of a preferred embodiment of an edge lit exit sign unit with lamp assembly with reflector, housing and panel mounting means of the present invention.

FIG. 9 is an end cross section of a preferred embodiment of an edge lit exit sign unit with lamp assembly with reflector, housing and panel mounting means of the present invention. This edge-lit exit sign unit 120 comprises a reflector element 122 disposed over the lamp assembly - in the cross section the lamp 124 and tubular outer housing 126 are shown. The viewing portions 128 are essentially transparent acrylic or other material panels. The viewing panels and reflector with lamp assembly are contained and secured together with a bolt 130 through the viewing panels and pinched together by an assembly headpiece 132. This bolt might be replaced with a rivet, screw, adhesive or other connecting means and will be known to those skilled in the art. In any event, once the unit is assembled and the lamp energized, light is directed in essentially the direction shown by arrow A. It will be understood that the purpose of the reflector element 122 is to direct the omnidirectional light produced by the CCFL lamp down into the viewing panels such that lettering or other indicia will be illuminated by internal reflectance. It will be apparent that the assembly headpiece 132 can be configured in many different sizes and shapes. Any suitable headpiece which keeps the components together and directs the light, via the reflector element, downward into the viewing panels through their top edge surfaces 134 will suffice. The edge lit or flat panel signs described in the present invention are possible mainly due to the advent of the miniature CCFL lamps. Because these small-diameter light sources are available, given the rest of their unique characteristics, these edge lit signs can be manufactured economically and efficiently.

Figure 10:
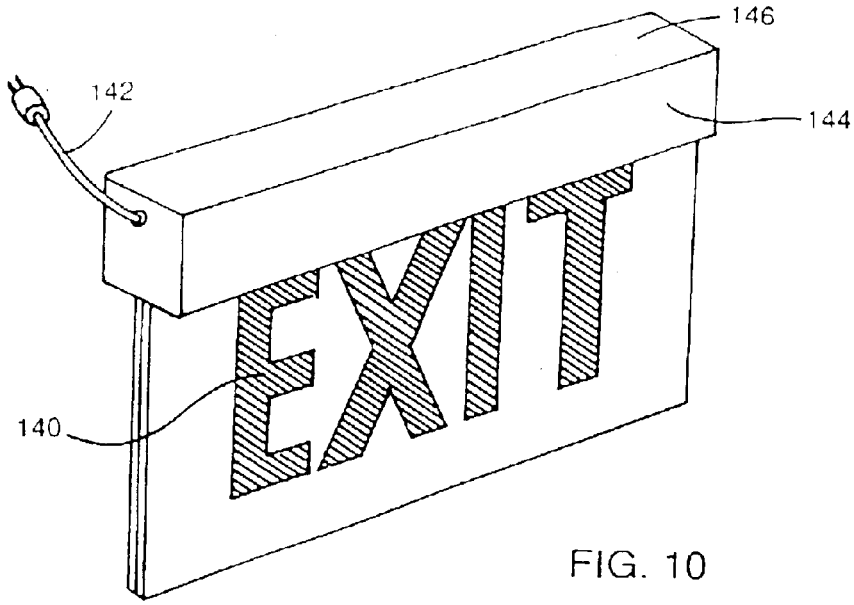
FIG. 10 is a perspective view of a preferred embodiment of an edge lit exit sign unit of the present invention.

FIG. 10 is a perspective view of a preferred embodiment of an edge lit exit sign unit of the present invention. The lettering or other indicia 140 will be illuminated by internal reflectance. Once the unit is powered by connection of the power source lead wires 142, the light can be operated. It will be understood that any additional electronics, in addition to the electronic ballast, inverter or other necessary or optional peripheral could be disposed within the upper chamber 144 in the assembly headpiece 146. These additional electronics may also be disposed at a point not integral with (remote from) the edge-lit exit sign unit, for example, at a central power distribution point in the building, at a point directly above the sign in a wall or ceiling, etc.

Figure 11:
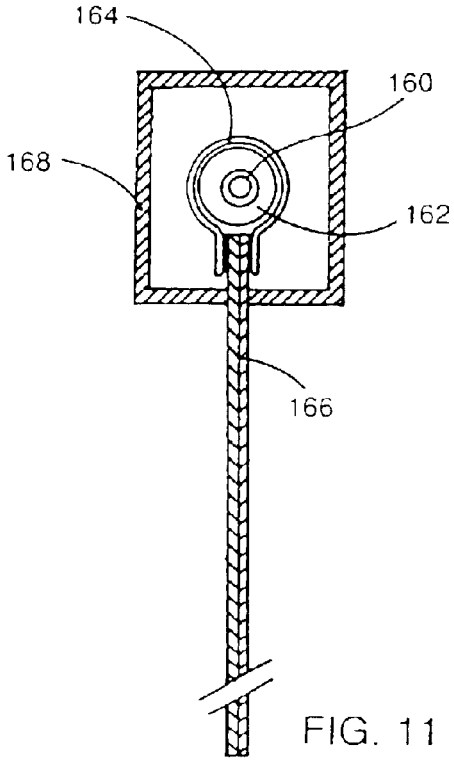
FIG. 11 is an end cross section of a preferred embodiment of an edge lit exit sign unit with lamp assembly, reflector, housing and panel mounting means of the present invention.

FIG. 11 is an end cross section of a preferred embodiment of an edge lit exit sign unit with lamp assembly, reflector, housing and panel mounting means of the present invention. The lamp 160, tubular housing 162, reflector element 164 and viewing panels 166 are all secured together in an integral assembly by upper casing [1]68. This casing can be similar to the assembly headpiece of the prior embodiments and might contain a ballast, other electronics, power supply switching equipment, etc.

Figure 12:
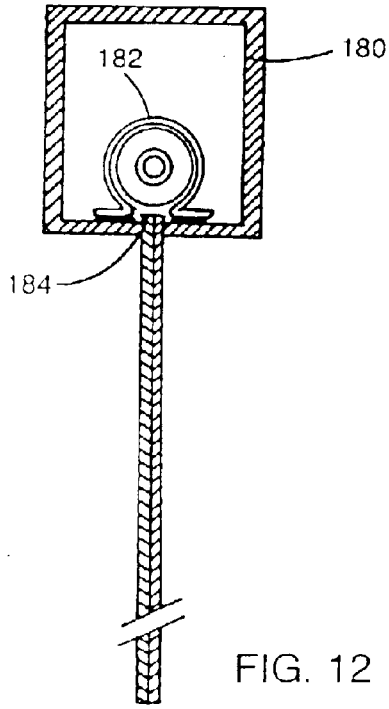
FIG. 12 is an end cross section of an alternative embodiment of an edge lit exit sign unit with lamp assembly, reflector, housing and panel mounting means of the present invention.

FIG. 12 is an end cross section of a preferred embodiment of an edge lit exit sign twit with lamp assembly, reflector, housing and panel mounting mean of the present invention. The upper casing 180 is somewhat different than that of FIG. 11 in the connection made between the elements. In both embodiments, however, the precise coupling structure is intended not only to give support and mounting means to the entire unit, but is also designed to internally reflect as much as possible of the radiating light from the lamp via the reflector element 182 into the top edges 184 of the viewing panels for subsequent illumination of lettering or other signage indicia.

Figure 13:
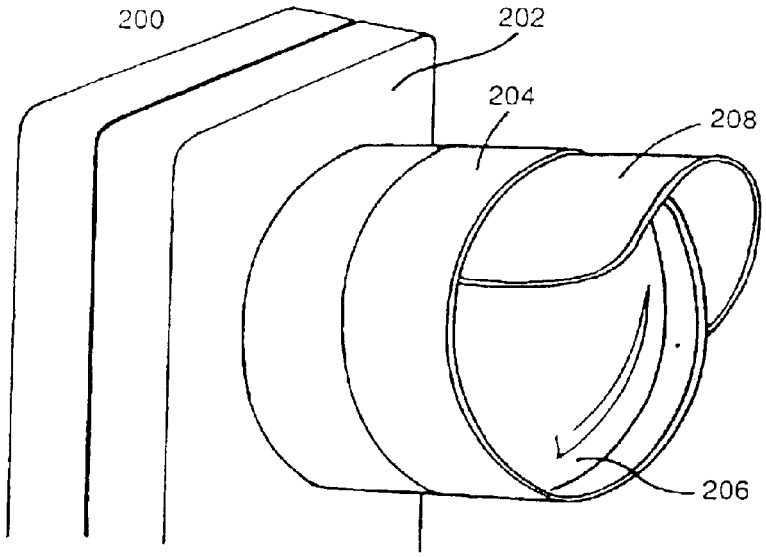
FIG. 13 is a perspective view of a traffic signal unit of the present invention.

FIG. 13 is a perspective view of a traffic signal unit of the present invention. The typical traffic signal unit 200 of the prior art has a main housing 202, a back chamber 204, a viewing lens 206 and an overhead visor 208. The viewing lens will be one of the typical and known colors: red, yellow or green. Alternatively, the individual lamps or lamp assemblies may create colored illumination. In this case, the viewing lens may be clear.

Figure 14:
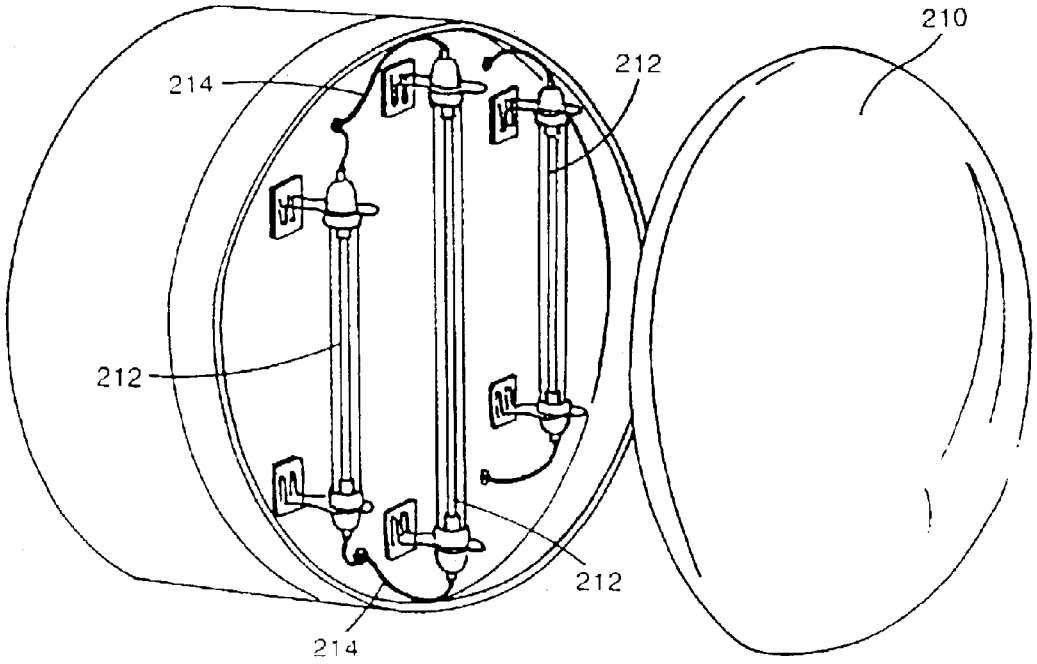
FIG. 14 is an internal perspective view of a traffic signal unit with a plurality of lamp assemblies and mounting clips of the present invention.

FIG. 14 is an internal perspective view of another traffic signal unit with a plurality of lamp assemblies and mounting clips of the present invention. Once the viewing lens 210 is removed the CCFL lamp assemblies 212 are visible. It will be understood that the traffic signal ;unit may also comprise a diffuser element. Though not shown, it will be known by those skilled in the art that a diffuser element could be placed between the CCFL lamp, lamp assembly or plurality of such and the viewing lens. The traffic signal could operate with only one lamp assembly, but could also be configured with more as shown. The lamp assemblies comprise an outer tubular transparent housing and a CCFL lamp. Power lead wires 214 link the lamp assemblies together and to the ballast inverter or other associated electronics. It will be understood by those skilled in the art that the back chamber portion 216 would contain these associated devices.

Figure 15:
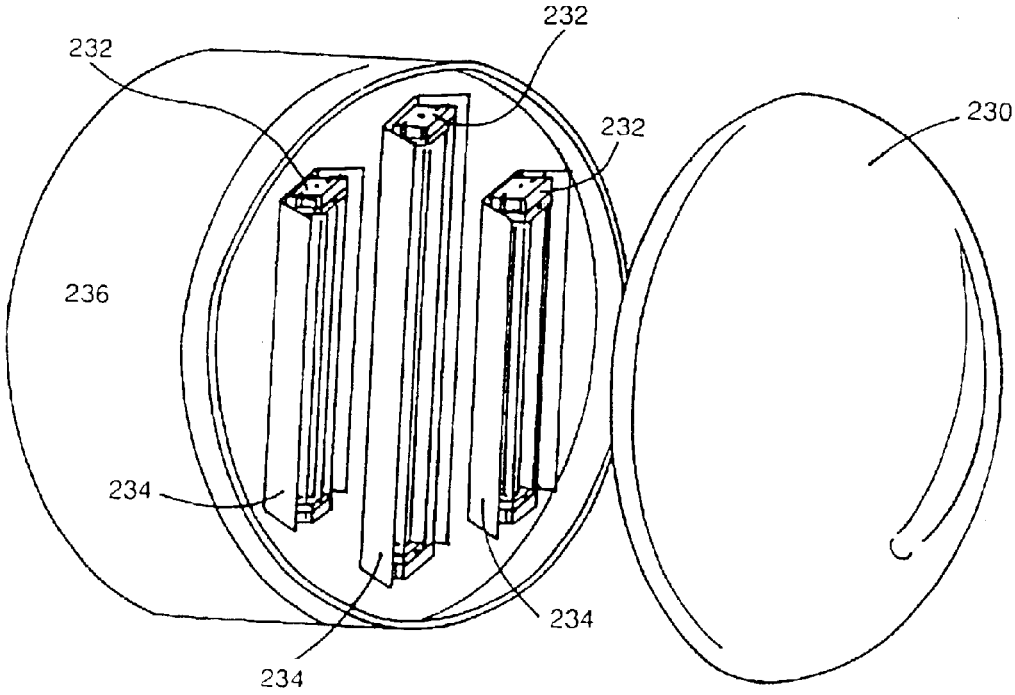
FIG. 15 is a perspective view of a traffic signal unit with reflectors of the present invention.

FIG. 15 is a perspective view of another traffic signal unit with reflectors of the present invention. In the present embodiment, once the viewing lens 230 is swung open, the lamp assemblies 232 are exposed. Each lamp assembly will have an associated reflector element 234 to reflect the omnidirectionally radiating light out the front of the unit through the viewing lens Although power lead wires which link the lamp assemblies together and to the ballast, inverter or other associated electronics will be present, for clarity and simplicity they are not shown. It will be understood by those skilled in the art that the back chamber portion 236 would contain these associated devices. The plurality of lamp assemblies may all be of the same length or they may be of different, graduated dimensions. The plurality of lamps will serve a plurality of purposes. As in the previous embodiments, the plurality of lamps or lamp assemblies will provide increased illumination, redundant illumination in the event of lamp failure, etc.

Figure 16:
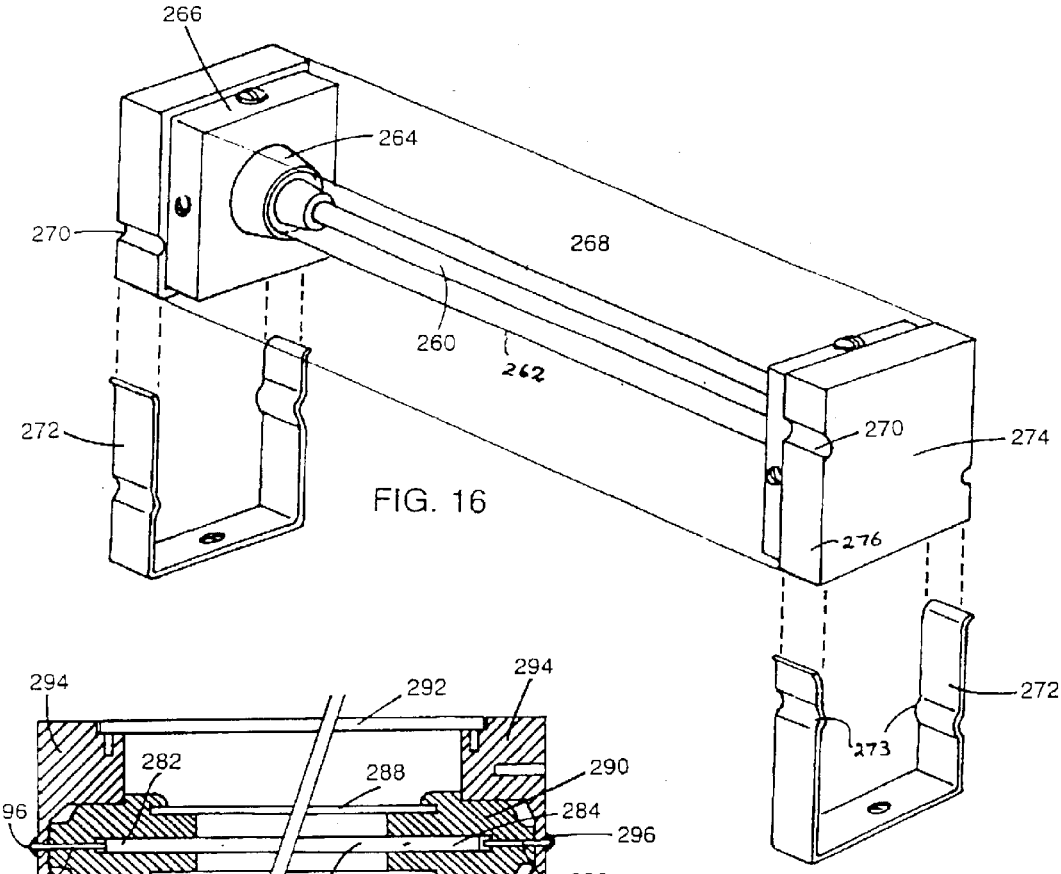
FIG. 16 is a perspective view of a light assembly of the present invention for use in general lighting applications.

FIG. 16 is a perspective view of a light assembly of the present invention for use in general lighting applications. The CCFL lamp 260 is disposed within a outer tubular housing 262. End fittings 264 seal the end between the outer tubular housing and the lamp. End wall assemblies 266 serve to support and maintain the lamp assembly (lamp, housing, end fittings) integrity and will be present on either end of the elongated unit. Opaque, essentially transparent or colored transparent protective panels 268 can be placed on one or more sides of the essentially cubic rectangular or tubular assembly held together by attachment to the end walls. These panels could also be coated with a reflective coating, film or other material. They might also serve as diffuser panels to soften or otherwise alter the nature of the radiating CCFL light. It will be understood that the outer tubular housing will be present in a preferred embodiment but may not be necessary in a customary embodiment inasmuch as while the dual protection afforded by both an outer tubular housing and the protective panels themselves may be necessary in certain applications, customarily, as a lamp module which can be installed into an existing housing or lamp holder, the outer tubular housing can be dispensed with leaving the CCFL lamp within the plurality of protective panels in a sealed, conveniently packaged, standard configuration for adaptation into hundreds of potential cost-saving applications. Mounting slots 270 or other mounting means, including mechanical coupling devices are provided to hold the assembly in a ceiling, wall, hand-held or other type of lighting fixture. Mounting clips 272 will be provided. It will be observed that by providing mounting slots on the end wall assembly in a predetermined geometric orientation or spacing, the device will be directional, i.e., with corresponding bullets 273 or other protruding-type structure, the mounting slots on the end wall assembly will be held in place in specific orientation vis a vis the mounting clips. Electrical contacts at either end 274 of the light assembly will serve as inputs to power the light assembly. It will be understood that while the end wall assembly might have a plastic construction, an electrical contact will be on the side portions 276 of the end wall assembly. This may be a layer of conductive material or some other electrical contact means.

Figure 17:
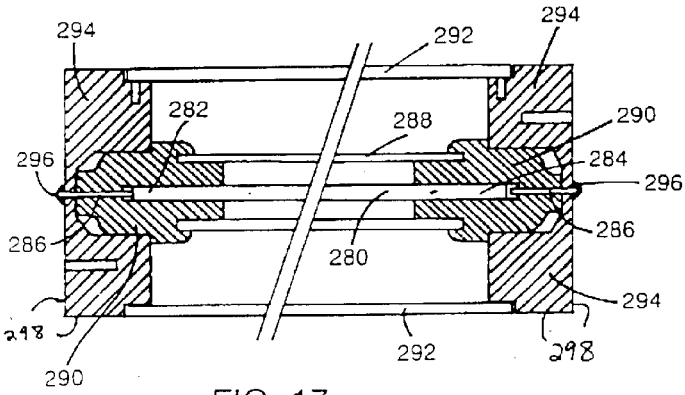
FIG. 17 is a cross section of a light assembly of the present invention for use in general lighting applications.

FIG. 17 is a cross section of a light assembly with protective housing of the present invention for use in general lighting applications. In cross section, the CCFL lamp 280 terminates at both a first end 282 and a second end 284 in electrodes 286. An outer tubular housing 288 is held in place with the lamp by end fitting 290 which incorporates the bushings that support the lamp 280. One or more transparent, opaque or semi-transparent or colored protective panels 292 are held in place by attachment to an end wall assemblies 294. Electrical leads 296, and in preferred embodiments, electrical contact surfaces 298, are configured to connect the electrode on the lamp with the power source wires (not shown). These contacts could be copper pieces, etc. In a preferred embodiment, electrical leads and contacts may be made integral with the end walls. Mounting holes or other mounting means, including mechanical coupling devices are provided to hold the assembly in a ceiling, wall, hand-held or other type of lighting fixture.

The light assembly (or lamp module) of the present invention is a novel and remarkable device. As an integrated unit, the light assembly can be manufactured in a variety of different standard sizes and shapes. They can be round, hemispherical, square or other shape in cross section. These light assemblies will be lightweight, weather and water proof, durable and economical. They form a sealed chamber which contains the CCFL and which is sealed from the exterior or ambient atmosphere in which the light operates. As the standard becomes more widely used, consumers will find it very convenient and economical, as well as inherently energy savings, to replace the entire integrated light assembly whenever an individual lamp fails. The mounting clips can be designed to be extremely flexible and adaptive to replacement of the light assemblies. Typical overall dimensions for the light assembly are between about ¼ and 1 inch square and between about 2 centimeters and 1 meter in length.

Figure 18:
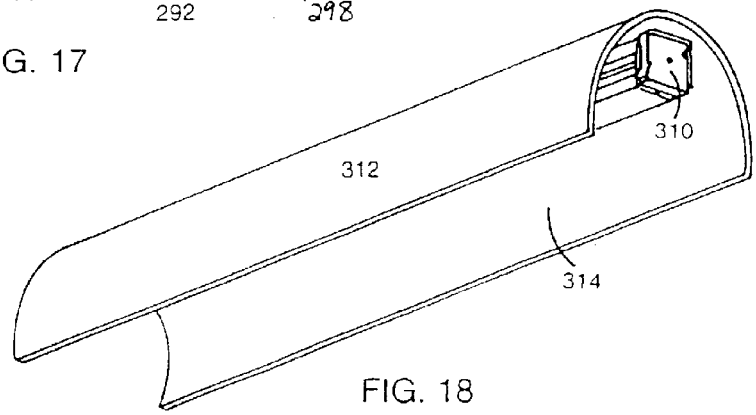
FIG. 18 is a perspective view of a task light assembly of the present invention.

FIG. 18 is a perspective view of a task light assembly of the present invention. A light assembly 310 is mounted inside of a task light housing 312. The housing, it will be understood, can be a plastic, metal, transparent, semi-transparent, opaque, or other type of material. It could be a reflector or a diffuser. The assembly is mounted on the inside 314 of the housing. The task light can be used in any conventional application but has the additional benefit of providing a high-illumination, low energy consuming device. Such characteristics give the task light of the present invention greater utility than those of the prior art This embodiment is especially useful for flashlights and other hand-held or mounted devices.

Figure 19:
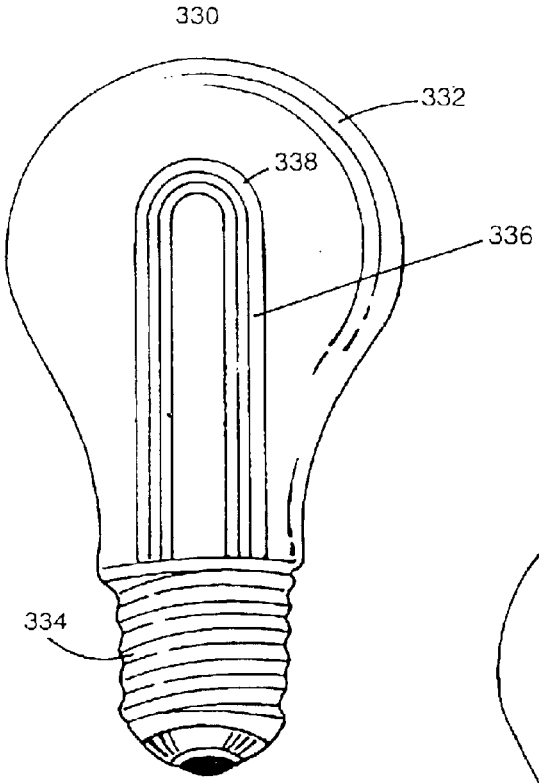
FIG. 19 is a perspective view of an A-lamp light bulb of the present invention.

FIG. 19 is a perspective view of an A-lamp light bulb 330 of the present invention. The A-lamp shape is well known and the electrode configuration with the socket is well known. Thus, by providing the same shape bulb portion 332, the present invention will be immediately useful wherever common incandescent bulbs 5 arc used. The base portion 334 is the same size and shape as the common incandescent bulb socket portion. The CCFL lamp 336 has a single U-shaped bend in the middle. A plurality of bends or CCFL lamps of different geometries would also be within the scope of the present invention and would be known to those skilled in the art. It will also be understood that a tubular housing 338 may or may not be necessary or desirable, depending upon the end use of the bulbs, optional use of diffusion materials in the lamp, housing or bulb portions, etc.

Figure 20:
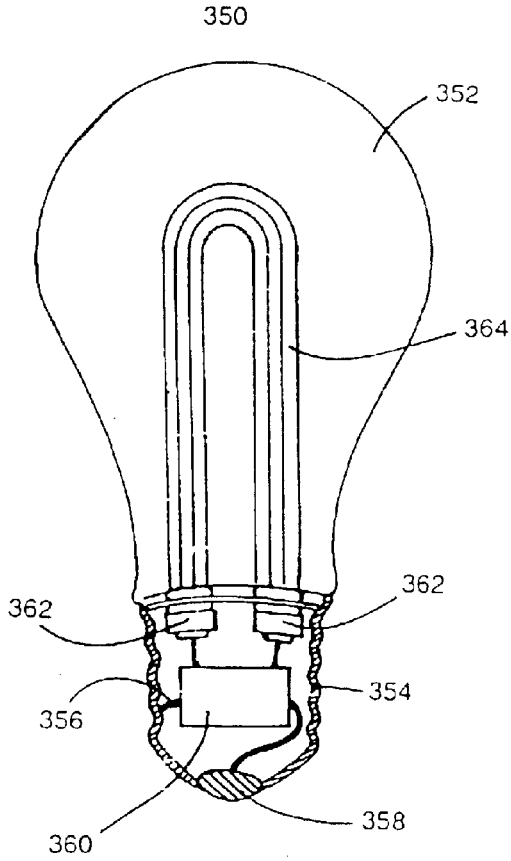
FIG. 20 is a cross section of an A-lamp light bulb with CCFL device, associated electronics and internal mounting means of the present invention.

FIG. 20 is a cross section of an A-lamp light bulb 350 with CCFL device, associated electronics and internal mounting means of the present invention. In cross section, the bulb portion 352 is coupled to the base portion 354. The base portion is comprised of a first 356 and a second 358 electrically-isolated low-voltage electrodes which are integral with the threaded mounting socket base portion. These low-voltage electrodes are designed to electrically couple with the line power of the standard A-lamp light or appliance socket. The ballast means 360 will be small enough to be placed in the base portion of the bulb. Connected to the ballast are the CCFL electrodes 362 which extend from either end of the U-shaped CCFL lamp 364.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles.

One such contemplated usage for the CCFL lamps and devices of the present invention is in hand-held illumination devices such as flashlights and torches. Other emergency lighting systems, including exit pathway lighting systems, are also likely candidates for conversion to CCFL devices using preferred embodiments of the present invention. The power conversion, inversion or other processing required by the CCFL lamps can be done in a ballast means located within the illumination device or remotely. For example, in certain applications, a single power source might be processed at a remote point and the actual required CCFL power is distributed directly to the illumination device. Furthermore, the power source might be comprised of a single or a plurality of photovoltaic cells with associated battery or other electricity storage means. The appended claims are intended to cover and embrace any and all such modifications, within the limits only of the true spirit and scope of the invention.

Figure 21:
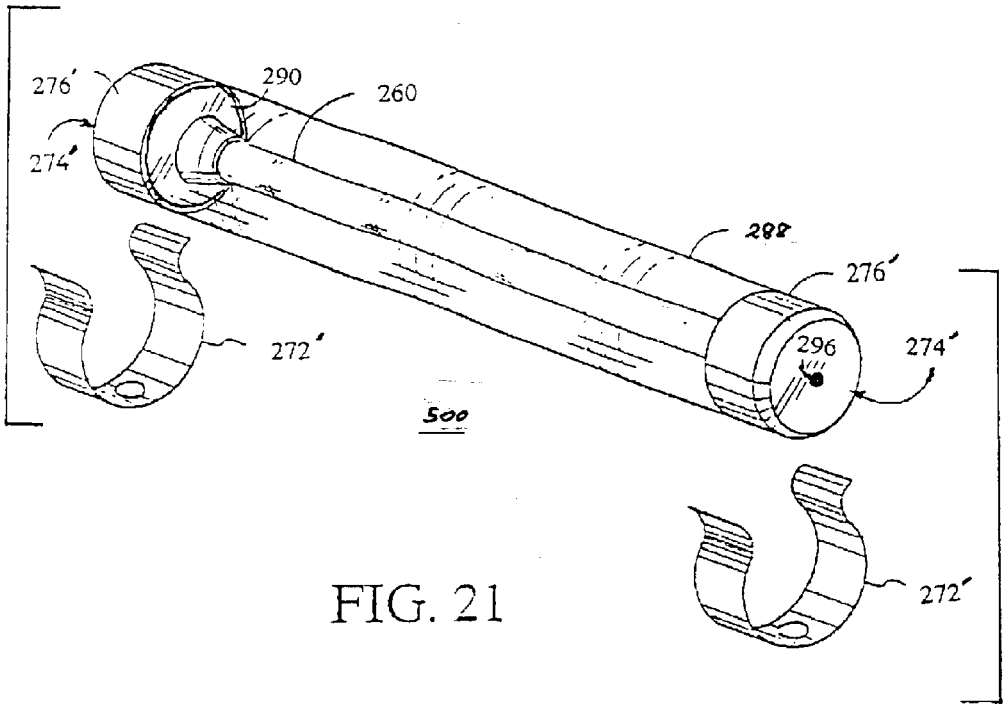
FIG. 21 is a perspective view of an alternative embodiment as a general light unit.

FIG. 21 shows a general lighting unit 500 incorporating the improvements of the present invention. As shown, the lamp elements of FIGS. 16 and 17 have been modified to change the end of the light assembly from square to round for use with a suitably modified mounting clip 272'. Accordingly, the same reference numbers have been used for similar elements but with primes added to the modified elements.

Figure 22:
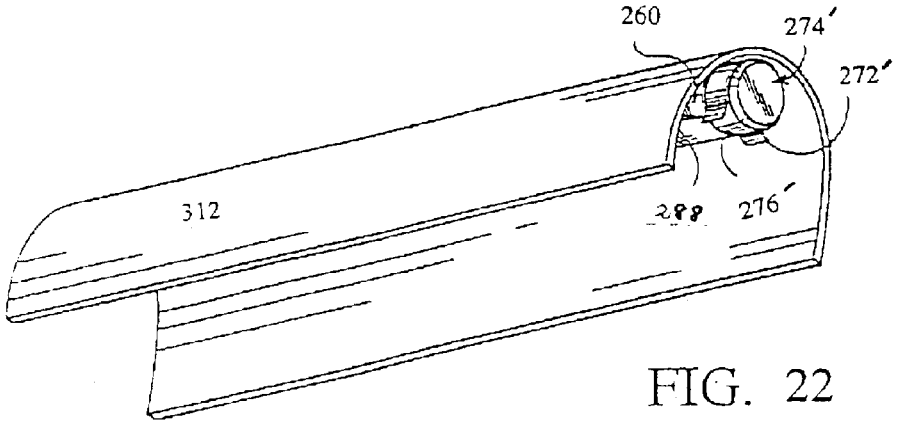
FIG. 22 is a view of a task light assembly according to an alternative embodiment of the invention.

FIG. 22 incorporates the general lighting unit 500 of FIG. 21 into a task light assembly similar to that shown in FIG. 18.

I claim:

1. A cold cathode fluorescent light assembly having first and second ends, comprising;

a) A cold cathode fluorescent lamp extending between the first and second ends of said light assembly, having a first electrode adjacent the first end and a second electrode adjacent the second end, said lamp further having a narrow tubular lamp wall extending between said electrodes;

b) an elongated outer protective chamber for retaining said lamp, said lamp being disposed within said chamber;

c) a first end cap at the first end of the light assembly and a second end cap at the second end of the light assembly, said caps being engageable with said protective chamber; and d) conductive means connected to said electrodes and extending through said end caps to permit connection of said electrodes to a source of electrical energy.

2. A cold cathode fluorescent light assembly according to claim 1, further including bushing means disposed between said lamp and said protective chamber for immobilizing said lamp within said protective chamber.

3. A cold cathode fluorescent light assembly according to claim 2, wherein said protective chamber and said end caps form a housing within which said lamp is supported by said bushing means.

4. A cold cathode fluorescent light assembly according to claim 2, wherein said bushing means are integral with said end caps.

5. A cold cathode fluorescent light assembly according to claim 1, wherein said end caps include means for supporting said lamp and immobilizing said lamp within said protective chamber.

6. A cold cathode fluorescent light assembly according to claim 5 wherein said end caps include means for supporting said protective chamber.

7. A cold cathode fluorescent light assembly according to claim 1, wherein said protective chamber is transparent.

8. A cold cathode fluorescent light assembly according to claim 1, wherein said protective chamber comprises a single, essentially tubular enclosure.

9. A cold cathode fluorescent light assembly according to claim 1, wherein said end caps receive and support said tubular lamp wall.

10. A cold cathode fluorescent light assembly according to claim 9, wherein said end caps receive and support said protective chamber.

11. A cold cathode fluorescent light assembly according to claim 1, wherein each of said end caps is apertured to receive said lamp and grooved to receive said protective chamber.

12. A cold cathode fluorescent light assembly according to claim 1, wherein said end caps each include an axial protrusion receiving and supporting said tubular lamp wall and a peripheral protrusion receiving and supporting said protective chamber.

13. A cold cathode fluorescent light assembly comprising:

a) lamp means including a housing having first and second ends and first and second electrodes at said first and second ends, respectively;

b) first and second end caps adapted to receive said first and second housing ends, respectively;

c) conductive means coupled to said electrodes and carried by said end caps to enable said electrodes to be connected to a source of energy; and d) elongated protective chamber means surrounding said lamp means and engageable with said housing ends to form a unitary structure.

14. A cold cathode fluorescent light assembly according to claim 13, further including bushing means for supporting said lamp means within said chamber means.

15. A cold cathode fluorescent light assembly according to claim 14, wherein said bushing means are integral with said end caps.

16. A cold cathode fluorescent light assembly according to claim 13, wherein said end caps each include a central opening to receive and support said first and second housing ends.

17. A cold cathode fluorescent light assembly according to claim 16, wherein said end caps each include a groove to receive and support said protective chamber.

* * * * *